United States Patent [19]

Bode et al.

[11] 4,069,632

[45] Jan. 24, 1978

[54] SHUTTERING MEMBER

[75] Inventors: Gerald Bode, Llanfrecha, near Cwmbran; Roy Worrall, Newport, both of Wales

[73] Assignee: Monsanto Limited, London, England

[21] Appl. No.: 411,133

[22] Filed: Oct. 30, 1973

[30] Foreign Application Priority Data

Nov. 6, 1972 United Kingdom ..... 51049/72

[51] Int. Cl.[2] ..... E04C 1/00

[52] U.S. Cl. ..... 52/309.7; 52/732

[58] Field of Search ..... 52/309, 262, 613, 600, 52/609, 495, 496, 479, 732, 335, 336, 542, 309.7

[56] References Cited

U.S. PATENT DOCUMENTS

| | | | |
|---|---|---|---|
| 2,178,097 | 10/1939 | Davison et al. | 52/600 |
| 2,229,619 | 1/1941 | Abeles | 52/723 |
| 2,794,756 | 6/1957 | Leverenz | 52/309 |
| 3,258,889 | 7/1966 | Butcher | 52/309 |
| 3,302,348 | 2/1967 | Pratt | 52/600 |
| 3,363,378 | 1/1968 | Palfey | 52/309 |
| 3,496,689 | 2/1970 | Nerem | 52/309 |
| 3,579,937 | 5/1971 | Lukens | 52/309 |
| 3,794,433 | 2/1974 | Schupack | 52/262 |

FOREIGN PATENT DOCUMENTS

| | | | |
|---|---|---|---|
| 810,077 | 1951 | Germany | 52/600 |
| 767,536 | 2/1957 | United Kingdom | 52/723 |

*Primary Examiner*—Leslie Braun

*Attorney, Agent, or Firm*—Joseph S. Nelson; William J. Farrington; James C. Logomasini

[57] ABSTRACT

The shuttering member of this invention comprises a foamed resin block rabbeted along at least two opposed longitudinal edges of the same major surface of the block and having internal strengthening rods across the width of the block. The invention also comprises a method of producing a foamed shuttering member having strengthening rods.

4 Claims, 4 Drawing Figures

SHUTTERING MEMBER

Figure 1:
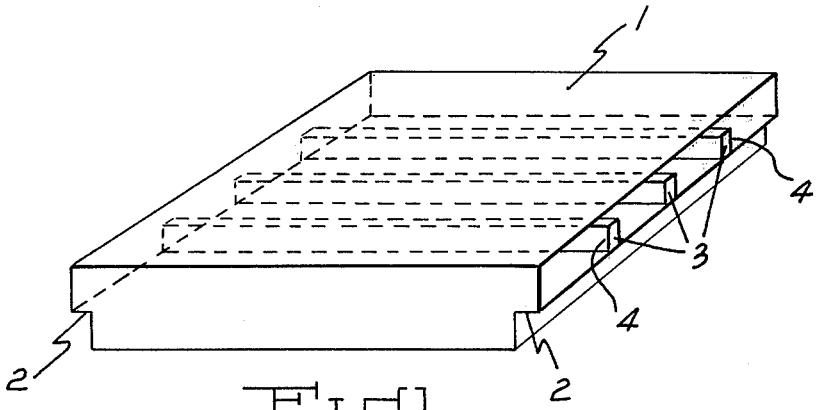

This invention relates to a shuttering member and to a method of constructing a reinforced concrete floor using such a member.

The use of concrete in traditional reinforced concrete construction methods has sometimes been wasteful since in many instances only a portion of the concrete is subject to tensile, shear or compressive forces. However, the portions of a structure not subject to any forces can be omitted without weakening the whole, resulting in a considerable saving in terms of the weight and the cost of the concrete.

This has led, for example, to the development of integral construction techniques in which a concrete floor is designed to eliminate non-functional portions of the concrete. A consequence of these techniques is the need for complicated and extensive shuttering to ensure that the concrete when poured goes only to desired locations between reinforced concrete beams that are to give the final support to the floor. While conventional wood shuttering can be used to form the necessary shapes or recesses in the floor, it has been found very convenient to employ foamed resin blocks as the shuttering, because they are easy to install, light to handle and can be left in place to improve the overall heat-insulating properties of the floor. Ordinary foamed resin blocks have however proved unsatisfactory in that when supported at their edges between reinforced concrete beams and subject to the compressive force of poured concrete in making the floor they have been known to split and make it necessary to relay the whole floor at considerable extra expense.

We have now devised a new shuttering member suitable for use in the construction of floor which greatly reduces the possibility of this occurring.

The shuttering member of this invention comprises a foamed resin block rabbeted along at least two opposed longitudinal edges of the same major surface of the block and having internal strengthening rods across the width of the block.

The invention also comprises a method of producing a foamed shuttering member having strengthening rods.

The invention also comprises a method of constructing a concrete floor which comprises providing a plurality of support beams and laying shuttering members as described above between adjacent beams such that the rabbeted edges engage the longitudinal edges of the beams, and pouring concrete to form the floor.

The floors produced by the above method are characterized by load-bearing ribs on the underside of the floor. These ribs very often are the support beams themselves, formed of reinforced concrete but they can be formed at the same time as the floor from concrete which occupies the space between adjacent rows of foamed resin blocks suitably reinforced with steelwork.

The overall design of the floor determines the shape of the foamed resin blocks required as shuttering but in the most preferred instances, i.e. where the floor has parallel spaced underside ribs, the blocks are rectangular in plan.

The cross-section of the block at right angles to the supported edges has an overall approximate T-shape with the upright stroke of the "T" located in use between the beams.

The strengthening rods in the block often make it possible to eliminate some of the foam so that the block can have a longitudinal channel cut in the rabbeted face over at least part of the length of the block giving it a cross-section (ignoring the rabbets) in the shape of an inverted "U", the channel thus formed being, in use, on the underside of the block and accommodated between the support beams when the block is in position.

The internal strengthening rods are preferably located within the block such that with the block in position the ends of the rods rest directly on the support beams.

Where the block has been channeled as described above it is often necessary for the rods to be so shaped as to conform to the cross-section of the block, e.g. a rod can be provided with legs as its extremities that extend parallel to the sides of the channel and preferably, when in use rest on the support beams. It is often preferred that the extremities of the reinforcing rods or legs attached thereto are rabbeted such that rabbeted surfaces are flush with the surfaces of the rabbets in the block.

Since the strengthening rods are primarily intended to minimize the risk of failure of the block under load between the supported edges, it is most effective and economical if the strengthening rods are shaped to have maximum resistance to flexing and breaking in a plane perpendicular to the top surface of the block. Thus, while the rods can have any desired cross-section such as square, triangular or round, the preferred section is rectangular with the longer dimension in the direction of the thickness of the block. Alternatively and often more preferably, the rod can have an L-shape, or inverted T-shaped cross-section such that one limb of the "L" or the cross bar of the "T" is in contact with the support beams when the block is in position. Such a configuration reduces the movement of the block when it is subject to compressive forces.

The strengthening rods themselves can be made from any convenient material such as metal, wood or certain rigid plastics such as acrylonitrile-butadiene-styrene (ABS) or a fiber-reinforced resin such as a glass-fiber reinforced styrene-acrylonitrile polymer (SAN). From the standpoint of economy and performance it is found that wood is very satisfactory and timber rods are in fact preferred in one embodiment of the invention. The wood selected is not critical and readily available soft or hard woods such as deal, oak or pine are quite satisfactory in practice. In an alternative preferred embodiment the rods are made from metal, such as steel, and have a generally L-shaped cross-section. Such rods are preferably provided with lengthwise slots. These angled rods are oriented within the block with one of the arms of the angle parallel to the rabbeted face of the block and preferably flush with the surface of the rabbet in contact with the support beam. This enables the slots in the rods to be used for attachment purposes either during or subsequent to the formation of the floor. The rods can be incorporated into the foamed resin block either by forming the block around them or by coating the rods with suitable adhesive and then inserting them in close-fit holes or slots in a preformed block so that they become firmly bonded to the surrounding foam. Even when the block is formed around the rods it is often advantageous to coat the rods with an adhesive beforehand. It is, of course, necessary that the adhesive be in a condition to adhere to the foam when contacted with it. In practice, this means, for example, that the adhesive needs to be tacky if the rod is to be inserted in a preformed slot or hole. Where the adhesive is in the tacky form when the rod and the foam are contacted it is clearly necessary that the solvent base used is not one that attacks the foamed resin. Apart from this any suitable adhesive can be used to bond the rods to the foam but generally an impact adhesive is preferred such as a rubber-based adhesive for polystyrene or polystyrene foam have both proved useful in practice.

The number of strengthening rods is frequently largely determined by the gap to be bridged between the support beams and the boad to be borne but in general it is found that a number from 2 to 6 and preferably 3 or 4 rods per meter of length (this being the dimension parallel to that of the support beams) is satisfactory. Since much stress can occur at the ends of the block, it is advisable to locate strengthening rods adjacent to each end of the block.

The dimensions of the block are very flexible but most frequently it is rectangular in plan and from 0.2 to 5 meters, for example, from 0.2 to 1.0 meters in length, and from 0.2 to 2.0 meters, for example, from 0.4 to 0.6 meters in width. The width, however, is often dictated by the design requirements of the floor. Sizes outside these ranges can be used but they are not in general preferred.

The block can be formed of any suitable rigid resinous foam such as, for example, a foamed polyurethane, polyvinyl chloride, urea-formaldehyde or vinylaromatic polymer. Foamed polystyrene is the preferred foamed resin from which the block is made, of a density of, for example, from 1 to 3 to 4 pounds per cubic foot.

The blocks are preferably formed by a direct molding process, though it is possible to form the block by cutting the required shape from a larger piece of foam.

Since the blocks in use are overlaid by a layer of concrete to form the floor surface it is sometimes preferred to make provision for the smooth flow of the wet concrete over the top surface of the blocks by providing that the top longitudinal edges are chamfered.

In the most frequently used process of forming a floor according to the invention the blocks of foamed resin are laid on reinforced concrete support beams so that each is supported at the edges as described above on an adjacent pair of beams, further reinforcing steelwork (if more is required) is placed in position between the blocks and concrete is poured over the whole to form the level floor surface.

Alternatively, the support beams can be provided by soffit shuttering, in which case reinforcing steelwork is laid along the soffit shuttering, the reinforced foamed resin blocks are placed in position as described above and whole floor, complete with reinforcing ribs, is formed in one operation when the concrete is poured.

Strengthened blocks of foamed resin useful in the process of the invention are illustrated in FIGS. 1 to 4 of the drawing.

Figure 2:
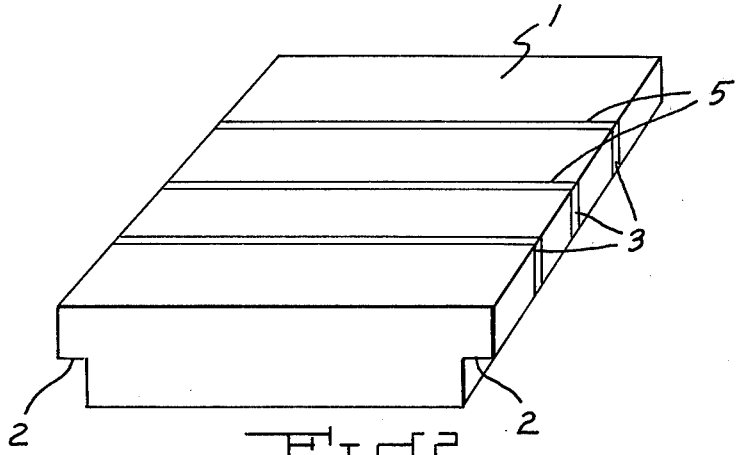

FIGS. 1 and 2 perspective view (not to scale) of two forms of block and

Figure 3:
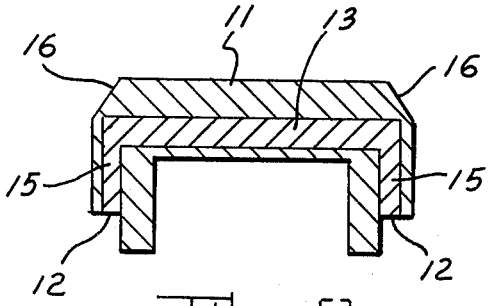
Figure 4:
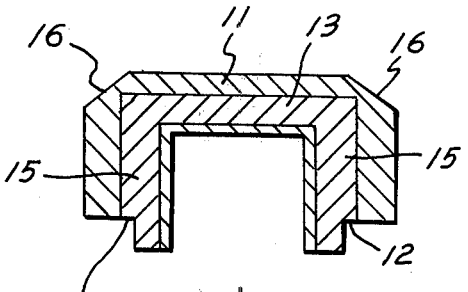

FIGS. 3 and 4 are cross-section views of further forms of block to show the position of reinforcing rods in the blocks.

In FIGS. 1 and 2 the block, 1, has rabbets, 2, cut in one pair of opposed edges. Strengthening rods, 3, are located in holes, 4, in FIG. 1 and in slots, 5, in FIG. 2.

In FIGS. 3 and 4 the block, 11, has an inverted "U"-shaped cross-section with rabbets, 12, on the outside portion of each arm of the "U". The strengthening rods, 13, have legs, 15, set in the arms of the "U". In FIG. 4, the legs, 15, have rabbets, 12, cut into them at their extremities. The longitudinal edges, 16, of the block in FIGS. 3 and 4 are chamfered.

The invention has been described in terms of the formation of floors but this term is understood to include all horizontal or substantially horizontal structures in a building whether they divide a lower part of a building from a part directly above or whether they form the roof or part of the roof of the building.

The invention is further illustrated by the following Examples:

EXAMPLE 1

Timber rods 510 × 30 × 5 mm. were coated with a rubber-base impact adhesive and allowed to dry during 30 minutes. Three of the rods were located in a mold 1 meter in length 510 mm. in width and 90 mm. in thickness at 250 mm. intervals. The mold was the invested with foamed polystyrene by filling the mold with prefoam granules of the foam and steam molding in a conventional manner.

Surface polystyrene was cut away to give the strengthened block illustrated in FIG. 1. The vertical part of the rabbet was 45 mm. in length and the horizontal part 30 mm.

The strengthened block was supported on its rabbets and subjected to the action of a man weighing about 80 kg. jumping about in the middle portion. The block easily withstood this test, but a similar block without the strengthening rods broke into pieces when tested in the same way. The block was used successfully to construct a reinforced concrete floor with a "T"-beam structure as described above.

EXAMPLE 2

A block of foamed polystyrene of the same dimensions as that of Example 1 was prepared and a grinding wheel was used to cut slots at 250 mm. intervals. Strengthening rods identical to those used in Example 1 and coated with a polystyrene foam adhesive were inserted in the slots to produce the strengthened block illustrated in FIG. 2.

The resulting block easily withstood the stresses involved in the test described in Example 1 and again was successfully used to construct a concrete floor with a "T"-beam structure.

EXAMPLE 3

The timber rods used in Example 1 were fitted with legs at either end by stapling wooden pieces, 150 mm. × 30 mm. × 30 mm. at right angles to the length of the rods. These were then coated with the impact adhesive used in Example 1 and placed in a mold 1 meter in length at 250 mm. intervals. The mold was then invested with foamed polystyrene in the manner described in Example 1. The molding thus obtained was trimmed using a hot wire to produce a block having the cross-section illustrated in FIG. 3 and a total thickness of 250 mm. The strengthened block easily withstood the pouring of concrete in a process of making a reinforced concrete floor as described above. A block of the same general dimensions as the above block but without the strengthening rods collapsed when supported at the edges and the equivalent weight of concrete was poured upon it.

It will be appreciated that, while the embodiments of the present invention as shown and described herein are necessarily limited to a few forms of the present invention, many variations and modifications thereof are feasible and practical without departing from the spirit and scope of the present invention discussed and claimed here.

What is claimed is:

1. A shuttering member comprising a foamed resin block having rabbets along at least two opposed longitudinal edges of the major surface of the block and having internal strengthening rods across the width of the block, in which the rabbeted face has a longitudinal channel cut into it over at least a part of the length of the block, the rods have legs at their extremities that extend at right angles to the rods and parallel to the side of the channel.

2. A member of claim 1 in which the extremities of the legs are flush with the rabbet surfaces which are parallel to the rabbeted face of the block.

3. A member of claim 1, in which the extremities of the legs are rabbeted such that leg rabbeted surfaces are formed which are flush with the surfaces of the rabbets in the block.

4. A member of claim 1 in which the rods having legs are made from wood.

* * * * *